US008176852B2

(12) United States Patent
O'Connor

(10) Patent No.: US 8,176,852 B2
(45) Date of Patent: May 15, 2012

(54) TOY TRACK

(75) Inventor: Stacy Lynn O'Connor, Long Beach, CA (US)

(73) Assignee: Mattel, Inc., El Segundo, CA (US)

( * ) Notice: Subject to any disclaimer, the term of this patent is extended or adjusted under 35 U.S.C. 154(b) by 198 days.

(21) Appl. No.: 12/581,737

(22) Filed: Oct. 19, 2009

(65) Prior Publication Data

US 2010/0123017 A1 May 20, 2010

Related U.S. Application Data

(60) Provisional application No. 61/106,572, filed on Oct. 18, 2008.

(51) Int. Cl.
*A63H 18/02* (2006.01)
*A63H 18/08* (2006.01)

(52) U.S. Cl. ..... 104/53; 446/444; 104/54; 104/DIG. 1

(58) Field of Classification Search ..... 105/53, 105/54, 55, DIG. 1; 446/429, 430, 437, 444, 446/168, 445; 238/10 A, 10 R, 10 E, 10 F
See application file for complete search history.

(56) References Cited

U.S. PATENT DOCUMENTS

| | | | | |
|---|---|---|---|---|
| 3,581,987 | A * | 6/1971 | Tomaro | 238/10 E |
| 4,564,197 | A * | 1/1986 | Lambert et al. | 463/64 |
| 2006/0113429 | A1 | 6/2006 | Arnau Manresa | |
| 2007/0049160 | A1 | 3/2007 | Matthes et al. | |

FOREIGN PATENT DOCUMENTS

| | | | |
|---|---|---|---|
| EP | 1710003 | A1 | 10/2006 |
| WO | 9949948 | A1 | 10/1999 |

OTHER PUBLICATIONS

International Search Report for PCT/US2009/061189 dated May 20, 2010.
Written Opinion of The International Searching Authority for PCT/US2009/061189 dated May 20, 2010.

* cited by examiner

*Primary Examiner* — S. Joseph Morano
*Assistant Examiner* — Zachary Kuhfuss
(74) *Attorney, Agent, or Firm* — Cantor Colburn LLP

(57) ABSTRACT

The invention is directed to a toy track for traversal of at least one toy vehicle. It includes a track segment having a flipper disposed therein, the flipper being attached to the track segment at a pivot point and capable of movement thereabout. A vibration damper post having a stanchion portion and a resilient portion for supporting the track segment is also included.

17 Claims, 5 Drawing Sheets

TOY TRACK

CROSS REFERENCE TO RELATED APPLICATIONS

This application claims the benefit of U.S. Provisional Application Ser. No. 61/106,572, filed Oct. 18, 2008, the contents of which are incorporated herein by reference thereto.

BACKGROUND

Toy vehicle play sets are well known in the art and have proven to be an extremely popular and long lasting toy product. In response to this popularity, a variety of toy vehicle track sets and toy vehicle play sets are provided. In many toy vehicle play sets, toy vehicles are provided which are not powered or freewheeling while in other toy vehicle play sets, self-powered toy vehicles are employed. Many freewheeling toy vehicles are acted upon by some type of accelerator or launcher to propel the toy vehicle down the track way, imparting considerable momentum thereon.

The tracks and track segments themselves are also subject to considerable variety. Many track segments are generally formed of a molded plastic material or the like and define a road surface having side rails or guides raised on each side thereof. The sidewalls or guides function to direct the toy vehicle along the roadway. In many toy vehicle playsets, the track way is formed as a closed circuit and the toy vehicles are operated in continuous laps upon the track circuit.

With increased sophistication of related arts and efforts in the toy art to improve products, the complexity and sophistication of toy vehicle track sets has increased. Tracks have become more complex with various loops and/or jumps replacing the standard oval track. In addition, various competitive type track sets have developed using multiple lanes and cars to provide a competitive racing feature. Other features such as speed boosters and lap counter stations have also been provided to further increase the play value of such tracksets. With the addition of these features, free-wheeling toy vehicles sometimes unintentionally "jump the track" rather than continue in the intended closed loop track.

Accordingly, it is desirable to provide a toy track set having energy absorbing features.

SUMMARY OF THE INVENTION

According to one exemplary embodiment of the present invention, a toy track is provided. It includes a curved track segment at least partially disposed along a first radius, the first radius generally disposed in a first plane, the track segment having an entrance end and an exit end and having a track surface with a width sufficient for at least one toy vehicle. An interior portion of the track segment is defined by a wall portion on an outside of said track segment and a shoulder portion on the inside of the track segment for maintaining the vehicles on the track surface. A flipper is disposed adjacent the wall portion and the entrance end. The flipper is attached to the track segment at a pivot point and is capable of movement thereabout.

According to another disclosed embodiment, a toy track set is provided. It comprises a curved track segment at least partially disposed along a first radius, the first radius generally disposed in a first plane. The track segment has an entrance end and an exit end and has a track surface with a width sufficient for at least one toy vehicle. An interior portion of the track segment is defined by a wall portion on an outside of the track segment and a shoulder portion on the inside of the track segment for maintaining the vehicles on the track surface. A vibration damper post is included and has a stanchion portion and a resilient portion for supporting the track segment. The resilient portion is in contact with an exterior portion of the track segment and extends between the exterior portion and the stanchion portion.

According to yet another disclosed embodiment, a toy track set is provided. It comprises a track segment having an entrance end and an exit end and has a track surface with a width sufficient for at least one toy vehicle. An interior portion of the track segment is defined by a wall portion on a first side of the track segment and a shoulder portion on a second side of the track segment, the track surface extending therebetween. A resilient flipper is adjacent the wall portion and the entrance end, the flipper being attached to the track segment at a pivot point and capable of movement thereabout. A vibration damper post having a stanchion portion and a resilient portion for supporting the track segment is also included. The resilient portion is in contact with the track segment and extends between the track segment and the stanchion portion.

When a toy vehicle enters the track segment, it encounters the flipper, which absorbs some of the kinetic energy from the toy vehicle. This, along with other features of the invention, allows the toy vehicle to traverse the track segment without "jumping the track."

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Figure 1:
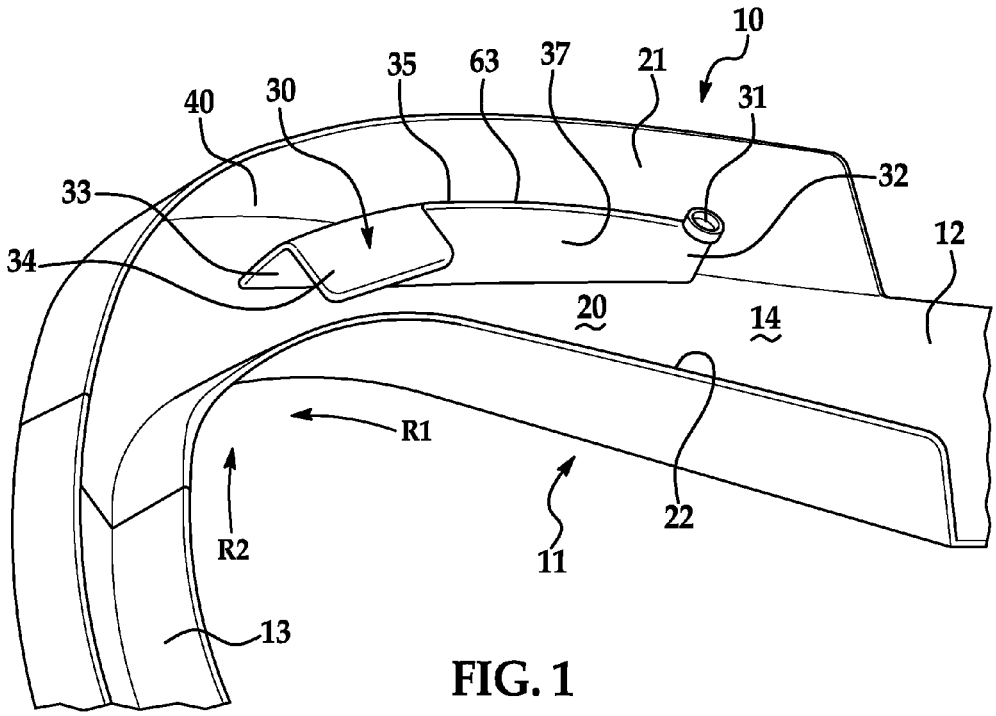
FIG. 1 shows the track of an exemplary embodiment of the invention.
Figure 2:
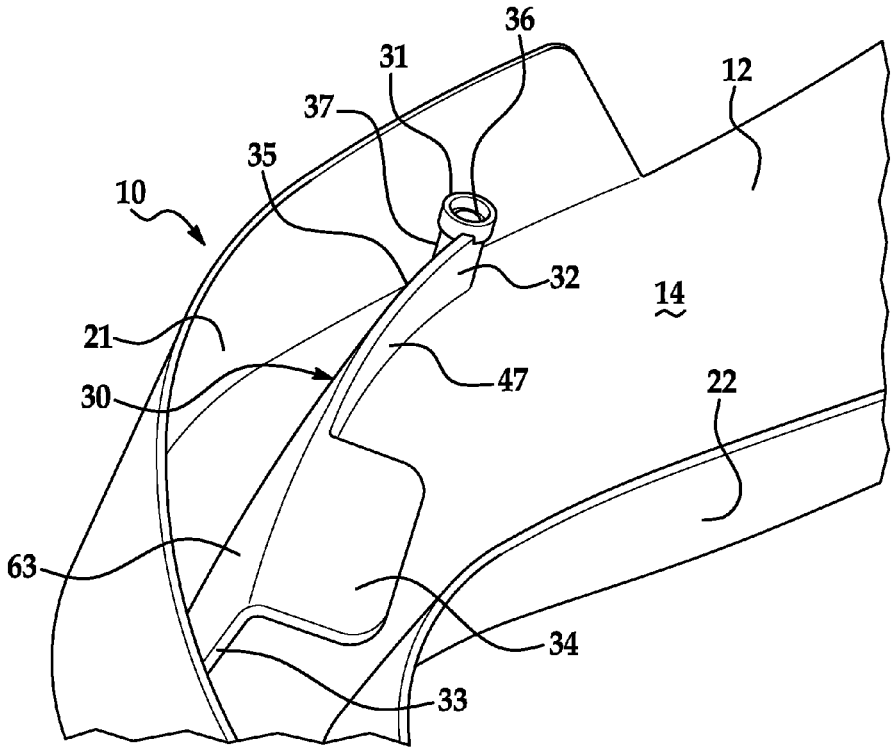
FIG. 2 shows one aspect of the disclosed embodiment of FIG. 1.

Referring now to the Figures, wherein exemplary embodiments of the present invention will be described with reference to specific embodiments, without limiting same, FIGS. 1 and 2 are perspective views of a toy track 10 constructed in accordance with the invention. In the general operation of toy track 10, a toy vehicle (not shown) repeatedly traverses a continuous loop circuit 49 and passes through a booster 51, shown at least in FIGS. 5 and 6, one or more times on each lap of the circuit 49. In accordance with conventional techniques, booster imparts kinetic energy to a toy vehicle during each pass to facilitate continuous travel of the toy vehicle upon toy track 10.

More specifically, a toy track segment 11 is formed of a molded plastic material or the like and may be entirely conventional in fabrication. Track segment 11 is formed as semicircular or curved shape, at least partially disposed along a first radius R1 and generally disposed in a first plane. Track segment 11 has an entrance end 12, and an exit end 13 and a track surface 14 therebetween, with a width sufficient for at least one toy vehicle. An interior portion 20 is defined by a wall portion 21 on an outside of the track segment 11 and a shoulder portion 22 on an inside of track segment 11 for maintaining the toy vehicle on the track surface 14.

A resilient arcuate flipper, member or arm 30 is attached to track segment 11 adjacent wall portion 21 and entrance end 12. The arcuate flipper 30 is attached to track segment 11 at a pivot point 31 and is capable of resilient movement thereabout. The arcuate flipper 30 is generally perpendicular to track surface 14, of course other configurations are contemplated. Arcuate flipper 30 generally extends between a first pivot end 32 and an opposite second end 33. The flipper 30 includes a tab 34, extending from an edge 35 of flipper 30, adjacent second end 33. Tab 34 is generally parallel to track surface 14, generally orthogonal to flipper 30 and extends towards shoulder portion 22. It will be appreciated that other configurations may be substituted for the general purpose of slowing the momentum of a toy vehicle as it traverses the track 10.

Figure 7:
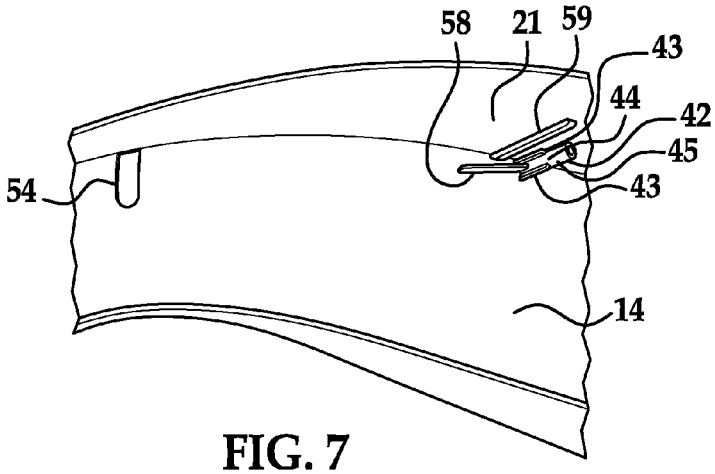
FIGS. 7 and 8 show additional details of a track segment and an arcuate flipper of exemplary embodiments of the present invention.
Figure 8:
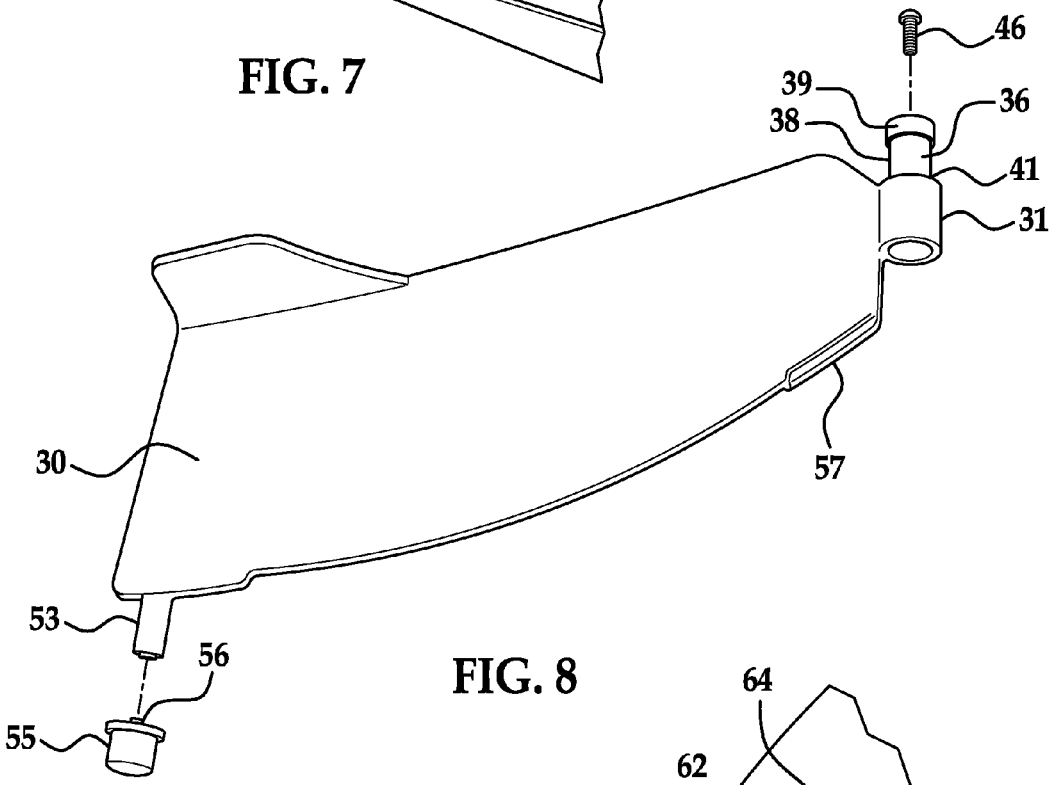

As best seen in FIGS. 7 and 8, pivot point 31 generally comprises a cylinder portion 37 and a pivot pin 36 having a sleeve 38 and a flange 39. A complementary peg 42 extends generally orthogonal from track surface 14. Peg 42 includes ribs 43 extending radially from an outer surface 44 of peg 42 and extending axially from track surface 14 about halfway up to an upper end 45 of peg 42. Cylinder portion 37 fits over the upper end 45 of peg 42 until it abuts the upper edge of ribs 43. Sleeve 38 fits into cylinder portion 37, while flange 39 extends above cylinder portion 37 and abuts an upper lip 41 of cylinder portion 37. A screw 46 extends into the sleeve 38 of pivot pin 36 and engages the interior portion of peg 42. In this manner pivot pin 36 retains flipper 30 on peg 42 of track segment 11, allowing arcuate flipper to partially rotate about peg 42.

In an alternate embodiment (not shown) a compression spring may be placed in cylinder portion 37 and circumferentially about pivot pin 36 to allow arcuate movement of flipper 31 when impacted by a toy vehicle. It will be appreciated that the pivot point 31 may alternatively comprise any number of resilient members including, but not limited to, a spring clip about a pivot pin 36, a plastic hinge, or even a flipper 30 comprised at least in part of spring steel.

Located at the opposite second end 33 of flipper 30, is a generally cylindrical stud 53 that extends through a slot 54 running partially across track surface 14 and up to wall portion 21. As best seen in FIG. 7, slot 54 runs generally perpendicular to the path of travel of a toy vehicle along track surface 14 of track segment 11. Stud 53 includes an interior threaded portion capable of receiving a plug 55, which engages stud 53 at an exterior portion 60 of track segment 11 and is held in place by a screw 56. During rotation of resilient flipper 30 about peg 42, stud 53 slides in slot 54 with plug 55 engaging exterior portion 60 to frictionally resist movement of flipper 30. The resiliency of flipper 30 is further enhanced with a groove 57 extending along a bottom edge of flipper 30 and a complementary radial finger 58 extending along track surface 14 to aid flipper 30 in absorbing kinetic energy as it is impacted by a toy vehicle. Protrusion 59 also aids in absorbing kinetic energy by acting as a stop to the wall side 63 of flipper 30 as it rotates about peg 42.

Figure 5:
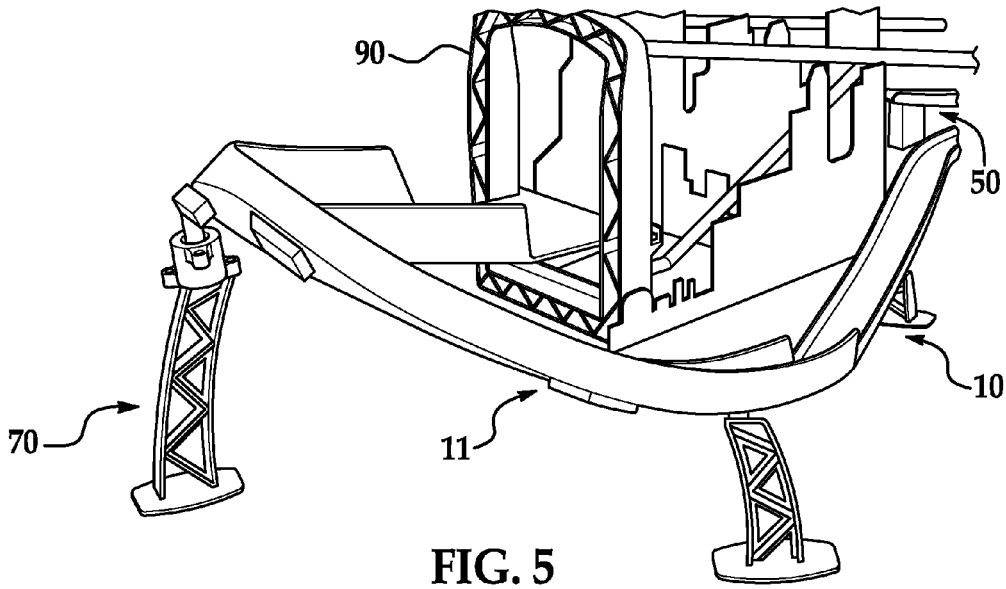
FIGS. 5 and 6 are illustrations of alternative exemplary embodiments of the present invention.
Figure 6:
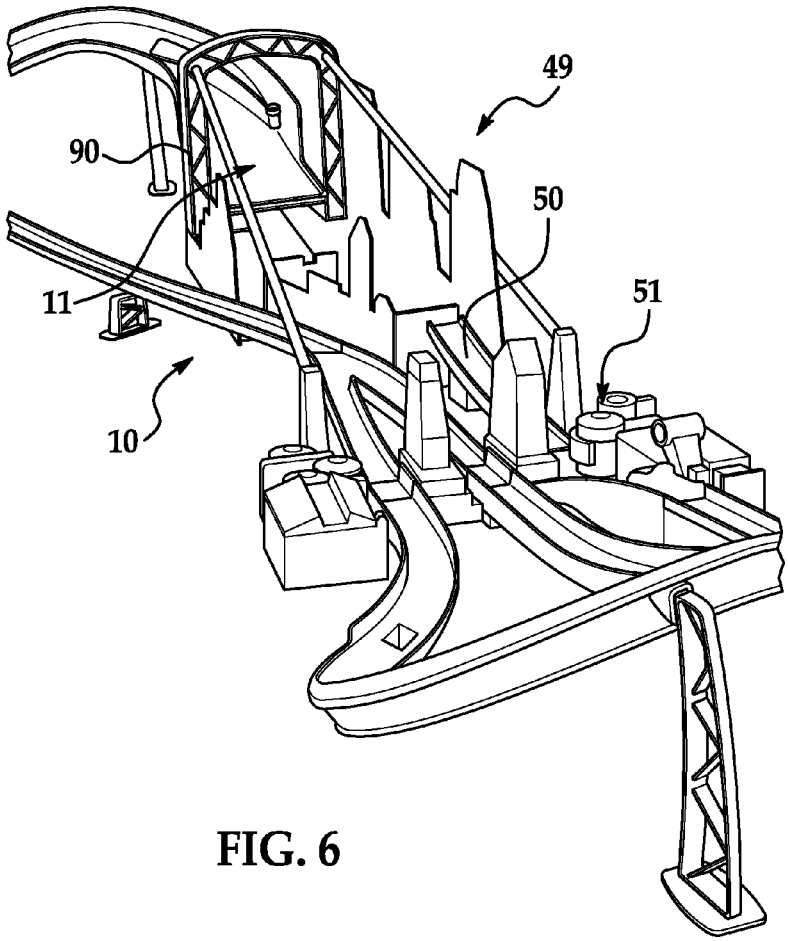

It will be appreciated that flipper portion 30 includes a first resting position 40 as shown in FIGS. 1 and 2 where opposite end 33 of flipper 30 is adjacent shoulder portion 22 and a second active position (not shown) in which opposite end 33 has been pivoted about pivot point 31 to a location adjacent wall portion 21. Thus, in operation, a toy vehicle enters track segment 11 at entrance end 12 from a jump 50, as is shown in FIGS. 5 and 6, which is substantially aligned with the entrance end 12 of track segment 11. The toy vehicle is then guided toward resilient flipper 30 by wall portion 21 and shoulder portion 22. Toy vehicle impacts an inner surface 47 of resilient flipper 30 causing flipper 30 to rotate about pivot point 31 and peg 42. Momentum from the toy vehicle is absorbed by resilient forces, including the coaction of stud 53 and plug 55 in slot 54, coaction groove 57 and radial finger 58, and the protrusion 59 which impacts flipper 30 at wall side 63. Furthermore, the natural resilience of the material from which flipper 30 is manufactured, which in one exemplary embodiment is a soft plastic material, also aids in absorbing the impact of the toy vehicle on flipper 30. In the exemplary embodiment shown, flipper 30 returns to the resting position by virtue of gravity acting on flipper 30 and plug 55, causing stud 53 to fall within slot 54 to a position opposite wall portion 21. In alternative embodiments (not shown) but discussed above, spring forces can be used in various ways to cause flipper 30 to move between a resting position and an active position.

The toy vehicle can continue about the track segment 11 to exit end 13, and is further kept from hurtling out of track segment 11 by extending tab 34 stopping any vertical momentum of the toy vehicle. Therefore, the toy vehicle may continue around track segment 11 without jumping from the track in the event that the toy vehicle enters the track segment 11 with too much momentum—such as might be caused when toy vehicle enters track segment 11 after traversing the jump 50, as seen in FIGS. 5 and 6. The booster 51, placed in close proximity to track segment 11, might also impart enough momentum to a toy vehicle such that track segment 11 would be useful to prevent a toy vehicle from jumping the track.

In another non-limiting embodiment, the track segment 11 is supported at the exterior portion 60, since track segment 11 is also banked along an arc, partially defined by a second radius R2. As shown in FIGS. 1 to 4, a bank angle increases from the entrance end 12 to a midpoint, and then decreases from the midpoint to the exit end 13.

Figure 3:
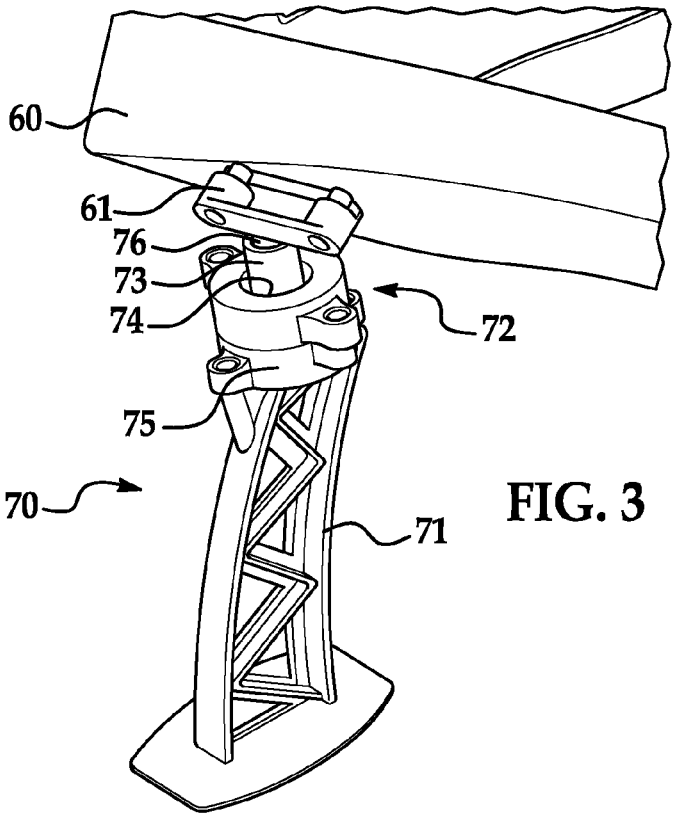
FIG. 3 shows another aspect of a disclosed embodiment.
Figure 4:
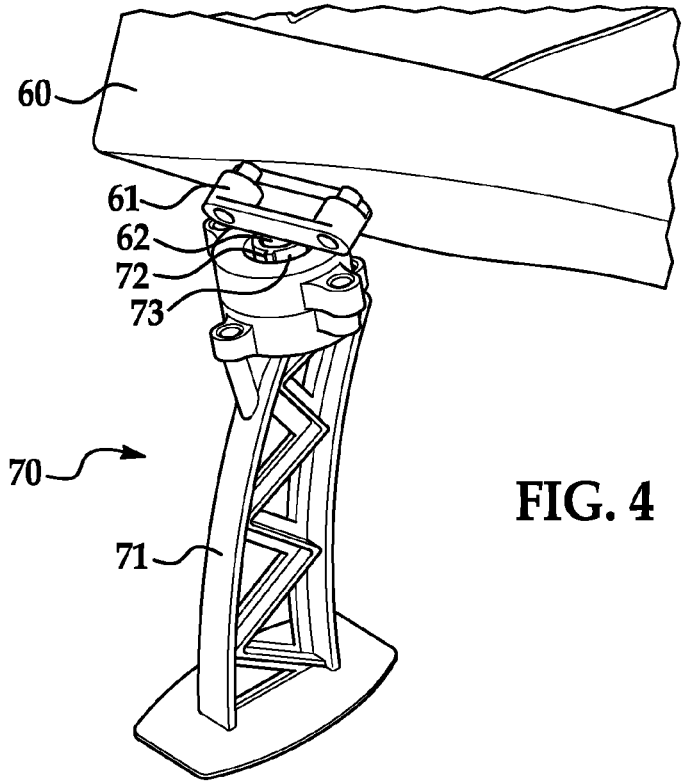
FIG. 4 shows yet another aspect of a disclosed embodiment.
Figure 9:
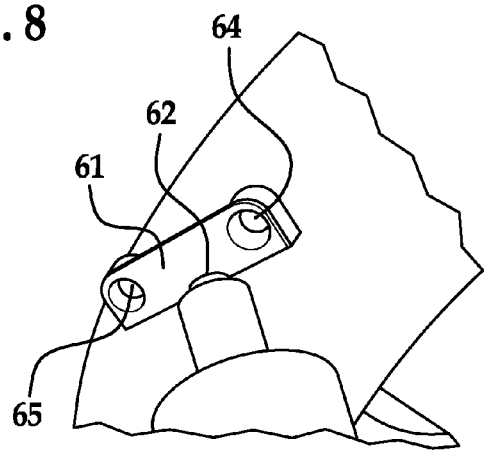
FIG. 9 shows yet another aspect of a disclosed embodiment.

Extending from exterior portion 60 of track segment 11 is a support portion 61 which, as shown in FIGS. 3, 4 and 9 is a separate molded piece and is attached to track segment 11 by screws 64 and 65. Extending from support portion 61 is a spherical ball portion 62. A vibration damper post 70 includes a stanchion portion 71 and a resilient portion 72, the resilient portion 72 being in contact with support portion 61. Specifically, stanchion portion 71 is in contact with a supporting surface for supporting track segment 11, while resilient portion 72 includes a reciprocating post 73 and a compression spring 77 seated within a spring seat or orifice 74 at a track end 75 of vibration damper post 70. Reciprocating post 73 further includes a support opening 76 having diametrically opposed slots 78 for releasably receiving spherical ball portion 62 of support portion 61. Reciprocating post 73 is held in place to track end 75 of post 70 by screws 81, thus capturing compression spring 77 therein.

Figure 10:
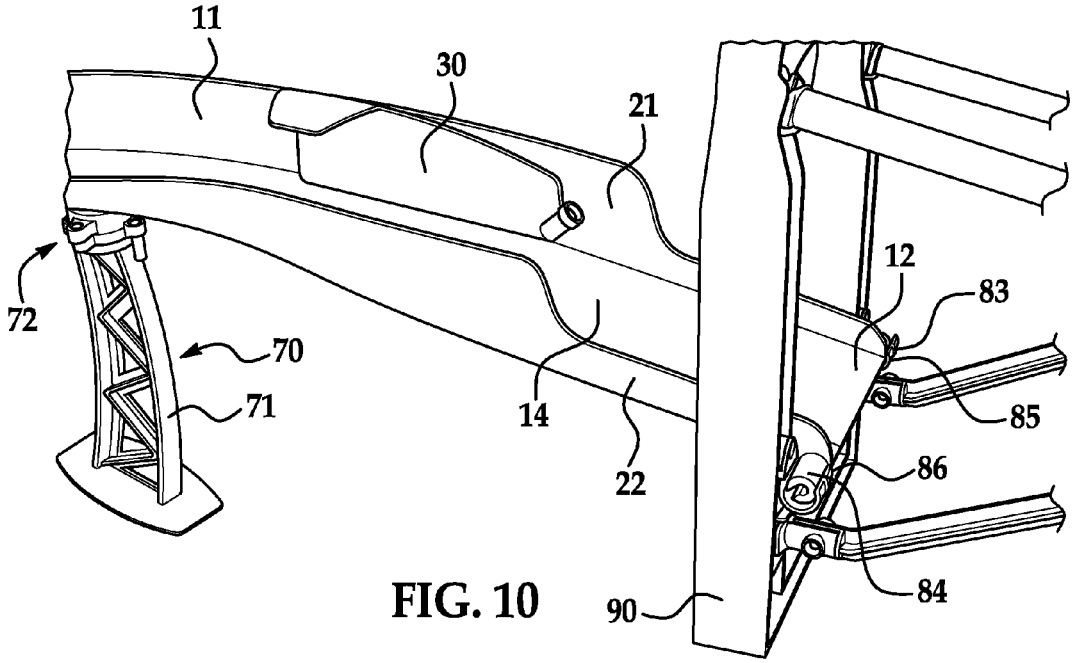
FIG. 10 is an illustration of a track segment of another exemplary embodiment of the invention.

As best seen in FIG. 10, track segment 11, in one exemplary embodiment includes cylindrical ears 83 and 84 extending outwardly from each of wall portion 21 and shoulder portion 22 respectively, adjacent track surface 14. Ears 83 and 84 are rotatably supported in cradles 85 and 86, extending from a support tower 90 of track set 10. Thus, track segment 11 is allowed to rotate about ears 83 and 84 as vibration damper post 70 reciprocates in a manner to absorb vibration and momentum.

Figure 11:
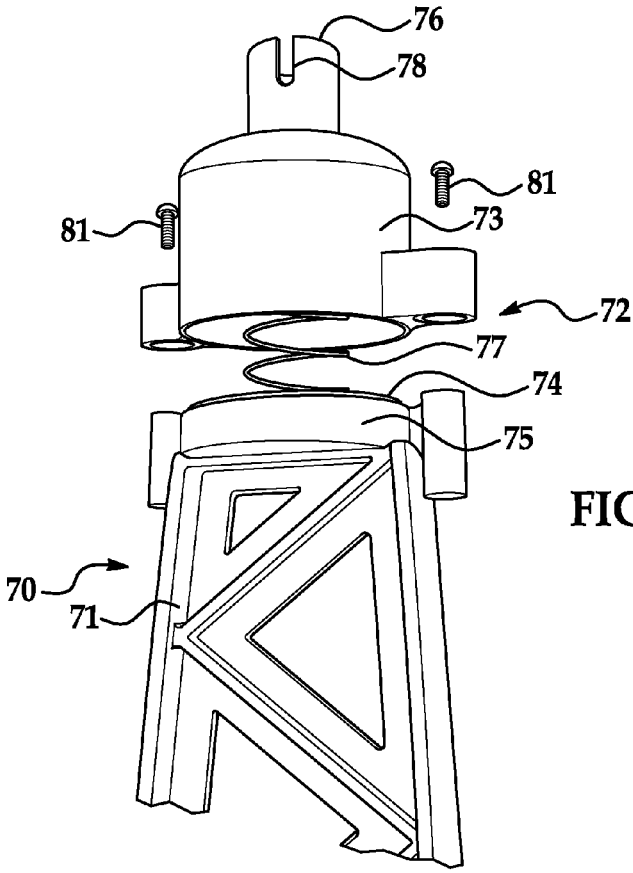
FIG. 11 shows one aspect of the embodiment shown in FIG. 10.

As can be seen from FIGS. 3, 4 and 11, when a toy vehicle enters track segment 11 from jump 50, it will impact resilient flipper 30. The momentum from the impact and the weight from the toy vehicle causes reciprocating post 73 to compress spring 77 within spring seat 74, dissipating kinetic energy from the toy vehicle, reducing the momentum of the toy vehicle and allowing the toy vehicle to finish traversing track segment 11 without jumping the track.

FIG. 3 shows reciprocating post 73 in a resting position, FIG. 4 shows reciprocating post 73 is in a compressed energy dissipating position and FIG. 11 is an exploded of vibration damper post 70. It will be appreciated that vibration damper post 70 may include any number of energy dissipating embodiments other than that shown herein. Examples may include any number of piston like devices, spring clips, springs or resilient portion 72 fabricated from a resilient material such as foam or rubber.

Furthermore, it will be appreciated that the non-limiting embodiments of the present invention may be used in combination or separately. For instance track segment 11, that includes resilient flipper 30, may be used without the vibration damper post 70. In a like manner, a standard track or curvilinear segment may be used with vibration damper post 70. In addition, the invention may be used without the jump 50 shown in FIGS. 6 and 7 and is useful in any situation where it is desired to dissipate the momentum of a toy vehicle.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which commensurate with the spirit and scope of the invention. Additionally, while various embodiments of the invention have been described, it is to be understood that aspects of the invention may include only some of the described embodiments. Accordingly, the invention is not to be seen as limited by the foregoing description.

What is claimed is:

1. A toy track comprising:

a curved track segment at least partially disposed along a first radius, said first radius generally disposed in a first plane, said track segment having an entrance end and an exit end and having a track surface with a width sufficient for at least one toy vehicle;

an interior portion of said track segment defined by a wall portion on an outside of said curved track segment and a shoulder portion on the inside of said curved track segment for maintaining said vehicles on said track surface; and a flipper adjacent said wall portion and said entrance end, said flipper attached to said track segment at a pivot point and capable of movement thereabout, wherein said track segment is also banked along an arc, said arc at least partially defined by a second radius, said second radius generally disposed in at least a second plane.

2. The toy track set of claim 1, wherein said flipper is a resilient arcuate flipper and extends between a first pivot end and an opposite second end, said resilient arcuate flipper including a tab extending from said flipper toward said shoulder portion.

3. The toy track set of claim 1, wherein said flipper extends between a first pivot end and an opposite second end, said flipper including a tab extending from said second end of said flipper and generally parallel to said track surface.

4. The toy track set of claim 1, wherein said flipper extends between a first pivot end and an opposite second end, said second end extends toward said shoulder portion in a resting position and a second active position in which said second end has been pivoted to a location adjacent said wall portion.

5. The toy track set of claim 1, wherein said track segment includes an exterior portion opposite said interior portion, a damper post having a stanchion portion and a resilient portion for supporting said track segment, said resilient portion in contact with said exterior portion and extending between said exterior portion and said stanchion portion.

6. A toy track comprising:

a curved track segment at least partially disposed along a first radius, said first radius generally disposed in a first plane, said track segment having an entrance end and an exit end and having a track surface with a width sufficient for at least one toy vehicle;

an interior portion of said track segment defined by a wall portion on an outside of said curved track segment and a shoulder portion on the inside of said curved track segment for maintaining said vehicles on said track surface; and a flipper adjacent said wall portion and said entrance end, said flipper attached to said track segment at a pivot point and capable of movement thereabout, wherein said pivot point comprises a peg and cylinder portion disposed over said peg, one of said peg and said cylinder portion extending from said track segment, the other of said peg and said cylinder portion disposed on said flipper.

7. The toy track set of claim 6, wherein said flipper is an arcuate flipper and said peg extends from said track surface of said track segment.

8. A toy track comprising:

a curved track segment at least partially disposed along a first radius, said first radius generally disposed in a first plane, said track segment having an entrance end and an exit end and having a track surface with a width sufficient for at least one toy vehicle;

an interior portion of said track segment defined by a wall portion on an outside of said curved track segment and a shoulder portion on the inside of said curved track segment for maintaining said vehicles on said track surface; and a flipper adjacent said wall portion and said entrance end, said flipper attached to said track segment at a pivot point and capable of movement thereabout, wherein said flipper extends between a first pivot end and an opposite second end, said opposite second end slideably attached to said track segment.

9. A toy track comprising:

a curved track segment at least partially disposed along a first radius, said first radius generally disposed in a first plane, said track segment having an entrance end and an exit end and having a track surface with a width sufficient for at least one toy vehicle;

an interior portion of said track segment defined by a wall portion on an outside of said curved track segment and a shoulder portion on the inside of said curved track segment for maintaining said vehicles on said track surface; and a flipper adjacent said wall portion and said entrance end, said flipper attached to said track segment at a pivot point and capable of movement thereabout, wherein said track segment includes a slot disposed therein, said flipper including a stud extending from said opposite second end and into said slot.

10. The toy track set of claim 9, wherein said stud extends through said slot and a plug is attached to said stud at an end extended through said slot to retain said stud in said slot.

11. A toy track comprising:

a curved track segment at least partially disposed along a first radius, said first radius generally disposed in a first plane, said track segment having an entrance end and an exit end and having a track surface with a width sufficient for at least one toy vehicle;

an interior portion of said track segment defined by a wall portion on an outside of said curved track segment and a shoulder portion on the inside of said curved track segment for maintaining said vehicles on said track surface; and a flipper adjacent said wall portion and said entrance end, said flipper attached to said track segment at a pivot point and capable of movement thereabout, wherein said track segment includes an exterior portion opposite said interior portion, a damper post having a stanchion portion and a resilient portion for supporting said track segment, said resilient portion in contact with said exterior portion and extending between said exterior portion and said stanchion portion, and wherein said resilient portion includes a reciprocating post and a compression spring seated in an orifice at an end of said stanchion.

12. The toy track set of claim 11, wherein said track segment includes a support portion extending from said exterior portion, said reciprocating post including a support opening, said support portion attached to said support portion.

13. A toy track set for traversal thereon of at least one toy vehicle comprising:

a curved track segment at least partially disposed along a first radius, said first radius generally disposed in a first plane, said track segment having an entrance end and an exit end and having a track surface with a width sufficient for at least one toy vehicle;

an interior portion of said track segment defined by a wall portion on an outside of said track segment and a shoulder portion on the inside of said track segment for maintaining said vehicles on said track surface; and a vibration damper post having a stanchion portion and a resilient portion for supporting said track segment, said resilient portion in contact with an exterior portion opposite said interior portion of said track segment and extending between said exterior portion and said stanchion portion, wherein said resilient portion includes a reciprocating post and a compression spring seated in an orifice at an end of said stanchion.

14. The toy track set of claim 13, wherein said track segment includes a support portion extending from said exterior portion, said resilient portion attached to said support portion.

15. The toy track set of claim 14, wherein said resilient portion includes a reciprocating post and a compression spring seated in an orifice at an end of said stanchion, said reciprocating post including a support opening, said support portion including a spherical portion extending therefrom, said spherical portion seated within said support opening.

16. A toy track set for traversal thereon of at least one toy vehicle comprising:

a curved track segment at least partially disposed along a first radius, said first radius generally disposed in a first plane, said track segment having an entrance end and an exit end and having a track surface with a width sufficient for at least one toy vehicle;

an interior portion of said track segment defined by a wall portion on an outside of said track segment and a shoulder portion on the inside of said track segment for maintaining said vehicles on said track surface;

a vibration damper post having a stanchion portion and a resilient portion for supporting said track segment, said resilient portion in contact with an exterior portion opposite said interior portion of said track segment and extending between said exterior portion and said stanchion portion; and a jump substantially aligned with said entrance end of said curved track segment.

17. A toy track set for traversal thereon of at least one toy vehicle comprising:

a curved track segment at least partially disposed along a first radius, said first radius generally disposed in a first plane, said track segment having an entrance end and an exit end and having a track surface with a width sufficient for at least one toy vehicle;

an interior portion of said track segment defined by a wall portion on an outside of said track segment and a shoulder portion on the inside of said track segment for maintaining said vehicles on said track surface; and a vibration damper post having a stanchion portion and a resilient portion for supporting said track segment, said resilient portion in contact with an exterior portion opposite said interior portion of said track segment and extending between said exterior portion and said stanchion portion, wherein said curved track segment includes a first ear extending from said wall portion adjacent said entrance end and a second ear extending from said shoulder portion adjacent said entrance end, each of said first and second ears rotatably supported in corresponding first and second cradles on a support tower.

* * * * *